US006224048B1

(12) United States Patent
Motamed

(10) Patent No.: US 6,224,048 B1
(45) **Date of Patent: *May 1, 2001**

(54) MIXED FORMAT DOCUMENT FINISHING SYSTEM RESPONSIVE TO A SINGLE PAGE HAVING AN ENCODED DOCUMENT ASSEMBLY SPECIFICATION

(75) Inventor: Margaret Motamed, Foster City, CA (US)

(73) Assignee: Electronics for Imaging, Inc., Foster City, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/008,895

(22) Filed: Jan. 20, 1998

(51) Int. Cl.[7] ..... B41F 13/54

(52) U.S. Cl. ..... 270/52.02; 270/52.16; 270/52.29; 270/1.02; 270/1.03

(58) Field of Search ..... 270/52.02, 1.02, 270/1.03, 1.01, 52.29, 58.03, 52.16, 58.05, 52.05

(56) References Cited

U.S. PATENT DOCUMENTS

| | | | | |
|---|---|---|---|---|
| 3,804,005 | * | 4/1974 | Burger et al. | 270/52.02 X |
| 3,917,252 | * | 11/1975 | Harder et al. | 270/52.05 |
| 3,966,186 | * | 6/1976 | Helm | 270/52.02 |
| 4,499,834 | * | 2/1985 | Ruetschle et al. | 270/58.03 |
| 4,602,776 | * | 7/1986 | York et al. | 271/303 X |
| 4,989,852 | | 2/1991 | Gunther, Jr. et al. | 270/56 |
| 5,013,022 | * | 5/1991 | Graushar | 270/52.02 X |
| 5,186,443 | * | 2/1993 | Manley et al. | 270/1.1 |
| 5,461,469 | * | 10/1995 | Farrell et al. | 270/58.08 |
| 5,489,091 | * | 2/1996 | Greer et al. | 270/52.02 X |
| 5,489,969 | | 2/1996 | Soler et al. | 355/207 |
| 5,547,178 | * | 8/1996 | Costello | 270/52.02 |
| 5,655,759 | * | 8/1997 | Perkins et al. | 270/52.02 X |
| 5,826,869 | * | 10/1998 | Nyffenegger et al. | 270/52.02 X |

FOREIGN PATENT DOCUMENTS

| | | | |
|---|---|---|---|
| 2935827 | 3/1981 | (DE) | B07C/5/38 |
| 439257A2 | 7/1991 | (EP) | B42D/5/02 |

* cited by examiner

*Primary Examiner*—Christopher P. Ellis
*Assistant Examiner*—Patrick Mackey
(74) *Attorney, Agent, or Firm*—Michael A. Glenn; Don Hendricks

(57) ABSTRACT

A hybrid mixed format document that contains document portions prepared by different format sources, such as both black and white and colored pages, prepared by separately printing the colored pages on a color printer, and the black and white pages on a black and white printer. The two document portions are then put in separate locations within a mixed format finishing device. One of the document portions, for example the black and white document portion, includes a cover sheet that provides encoded information, which tells the finishing device how to merge the two document portions into a complete publication. One advantage of the mixed format finishing device is that those pages that contain only text may be printed on a faster, and less costly black and white printer. In a preferred embodiment, the cover sheet controls the document merging process in such a manner that if one document is misprinted or mismerged, the mismerged document may be shuttled aside and merging may continue with the next complete document set.

22 Claims, 4 Drawing Sheets

MIXED FORMAT DOCUMENT FINISHING SYSTEM RESPONSIVE TO A SINGLE PAGE HAVING AN ENCODED DOCUMENT ASSEMBLY SPECIFICATION

FIELD OF THE INVENTION

The invention relates to the field of document assembly systems. More particularly, the invention relates to a document finishing system for the controlled assembly of mixed format documents.

BACKGROUND OF THE INVENTION

Document finishing systems are used for a variety of printing, compiling, and binding applications.

J. Soler, K. Moore, D. Miller, and R. Eisemann, *Apparatus and Method of Controlling Interposition of Sheet in a Stream of Imaged Substrates*, U.S. Pat. No. 5,489,969 (Feb. 6, 1996) disclose a technique for controlling the interposition of one or more special sheets into a stream of regular imaged substrates. In one example, the insertion of special sheets is determined by preset time intervals, which can be adjusted to accommodate the timing of hardware, such as printers. In another example, the interposition of a special insert sheet with the stream of imaged substrates is maintained by comparing the distance between a special insert sheet fed to the stream and an adjacent regular imaged substrate with a predefined tolerance, and adjusting the feed times of subsequent special insert sheets. While Soler et al. disclose complicated time and distance spacing between special sheets and a stream of regular substrates, they fail to disclose a comprehensive solution to providing an information map to compile an entire hybrid document.

D. Platteter and J. Carter, *System Architecture for Attaching and Controlling Muftiple Feeding and Finishing Devices to a Reproduction Machine*, U.S. Pat. No. 5,629,775 (May 13, 1997) disclose an electronic image processing apparatus which includes a marking machine, a source of copy sheets, a controller, and a plurality of resources, in which each of the resources includes an associated processor for storing data related to the operational timing of the associated resource. While Platteter et al. disclose a system architecture for attaching multiple finishing devices to a reproduction machine, they fail to provide a document finishing device for assembling hybrid documents originating from a plurality of printers.

C. Conrad, R. Coons, and T. Cherry, *Sheet Inserter and Methods of Inserting Sheets into a Continuous Stream of Sheets*, U.S. Pat. No. 5,272,511 (Dec. 21, 1993) disclose a sheet inserter that "inserts special insert sheets into a continuous stream of sheets. The insert sheet and the continuous stream of sheets are then conveyed to a final destination, where the sheets are compiled into a stack. While Conrad et al. disclose the insertion of special sheets within a continuous stream of sheets, they fail to disclose the use of a mixed format finishing device that collates sheets from a number of sources in response to self-contained instructions residing on one of the sheets.

The disclosed prior art systems and methodologies thus provide basic document finishing systems, but fail to provide a mixed format document finishing device in which documents to be compiled include self-contained instructions which are used to compile the document. The development of such a mixed format finishing device would constitute a major technological advance.

SUMMARY OF THE INVENTION

A hybrid mixed format document that contains document portions prepared by different format sources, such as both black and white and colored pages, prepared by separately printing the colored pages on a color printer, and the black and white pages on a black and white printer. The two document portions are then put in separate locations within a mixed format finishing device. One of the document portions, for example the black and white document portion, includes a cover sheet that provides encoded information, which tells the finishing device how to merge the two document portions into a complete publication. One advantage of the mixed format finishing device is that those pages that contain only text may be printed on a faster, and less costly black and white printer. In a preferred embodiment, the cover sheet controls the document merging process in such a manner that if one document is misprinted or mismerged, the mismerged document may be shuttled aside and merging may continue with the next complete document set.

DETAILED DESCRIPTION OF PREFERRED EMBODIMENTS

Figure 1:
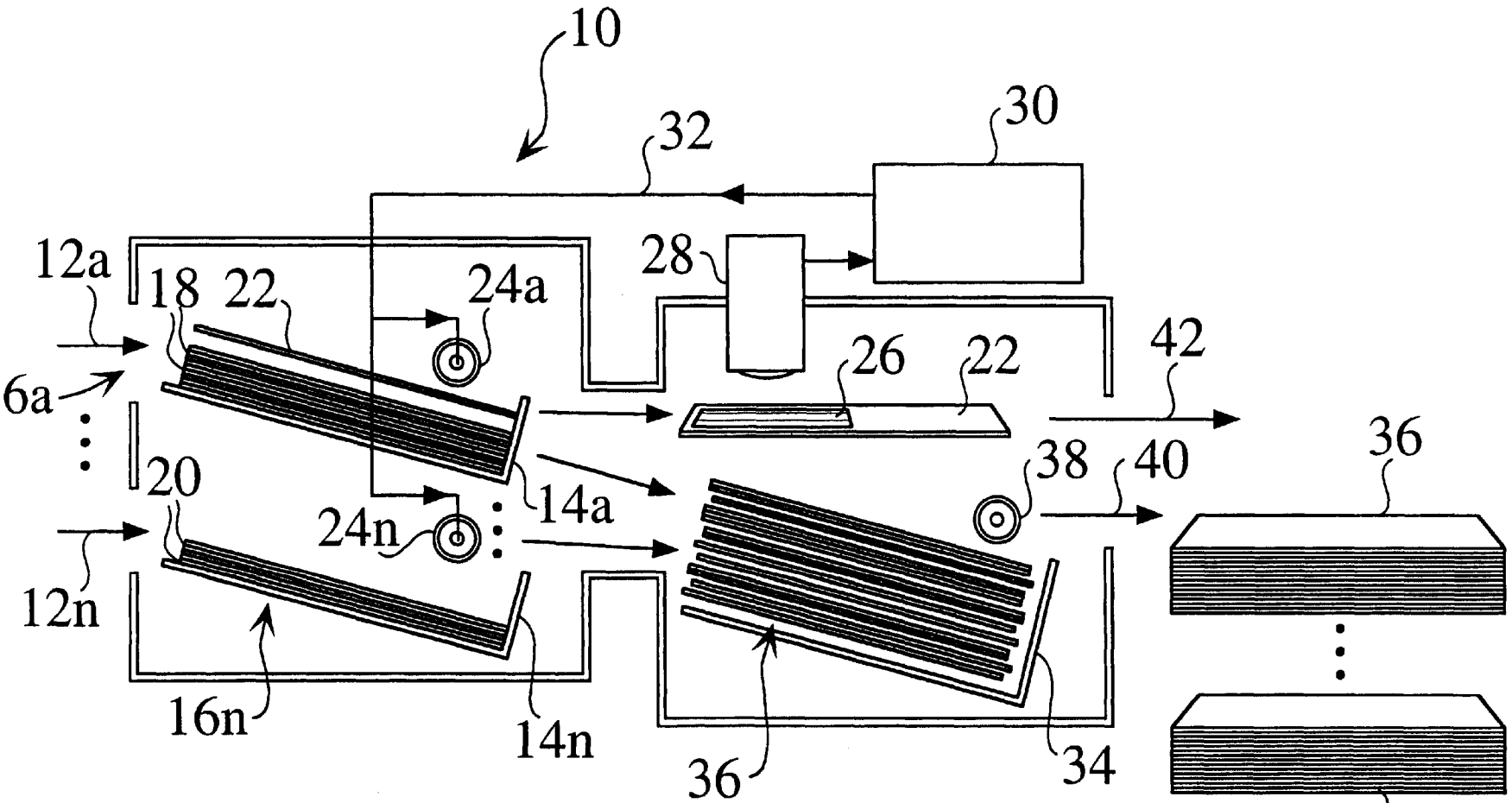
FIG. 1 is a side view of a mixed format finishing device.

FIG. 1 is a side view of a mixed format finishing device 10. A first document portion 16*a* is transferred 12*a* to the finishing device 10 from a first document portion source 52*a* (FIG. 2), and is stored in a first document portion storage bin 14*a*. Similarly, a second document portion 16*n* is transferred 12*n* to the finishing device 10 from a second document portion source 52*n* (FIG. 2), and is stored in a second document portion storage bin 14*n*. The first document portion 16*a* includes document pages 18 and a cover page 22. The cover page 22 includes encoded information 26, which tells the finishing device 10 how to merge or collate the first document portion 16*a* and the second document portion 16*n* into a complete hybrid document publication 36.

The cover page 22 is forwarded to a compiler sensor 28, which reads the encoded information 26, and transfers the encoded information 26 to a compiler controller 30. The compiler controller 30 selectively sends a page processing signal 32 to a first paper transfer device 24*a*, which moves pages 18 from within the first document portion 16*a* from the first document portion storage bin 14*a*. The page processing signal 32 is also selectively sent to a second paper transfer device 24*n*, which moves pages 20 from within the second document portion 16*n* from the second document portion storage bin 14*n*. Pages 18 from the first document portion 16*a* and pages 20 from the second document portion 16*n* are thus controllably collated or merged into a hybrid document 36, and are collected in a hybrid document storage bin 34. Compiled hybrid documents 36 are then controllably moved 40 out of the hybrid document storage bin 34 by a hybrid document transfer device 38.

Figure 2:
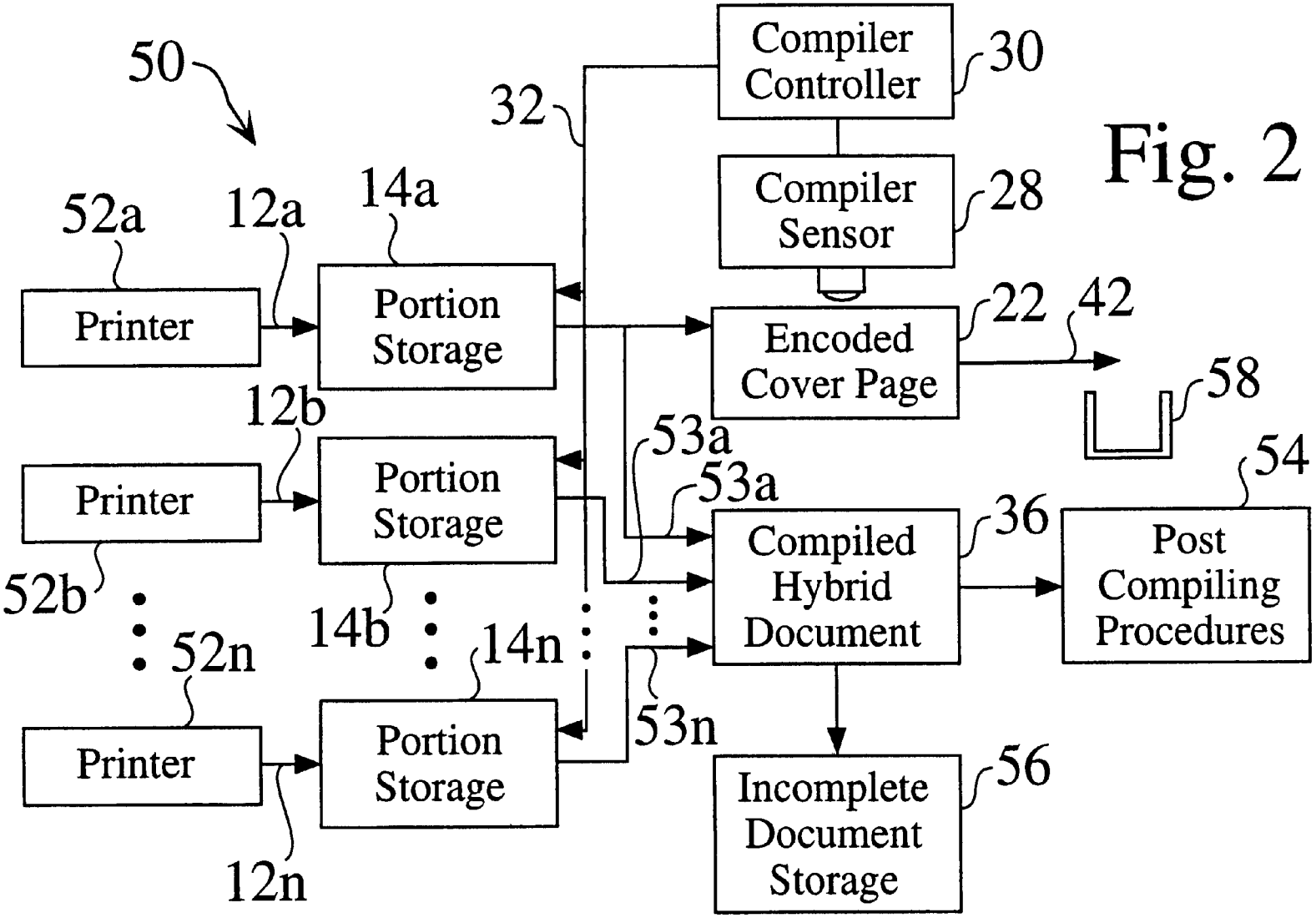
FIG. 2 is a block diagram of a mixed format finishing process.

The moved hybrid documents 36 are then available for post collation procedures, such as the addition of covers or document binding operations. Post collation procedure can also be controllably accomplished in response to encoded information 26 contained on the cover sheet 22. Cover sheets are typically diverted 42 away from the processing area, and may be collected in a cover sheet storage bin 58 (FIG. 2).

Mixed Format Document Finishing Process. FIG. 2 is a block diagram of the mixed format finishing process 50, which comprises the following steps:

i) receiving 12*a*–12*n* a plurality of document portions 16*a*–16*n* produced by one or more formats 52*a*–52*n*, one of said document portions 16*a* including a cover sheet 22 having encoded assembly information 26; and ii) compiling 53*a*–53*n* said plurality of document portions 16*a*–16*n* into a finished mixed format document 36 in response to said encoded assembly information 26 stored on said cover sheet 22.

Figure 6:
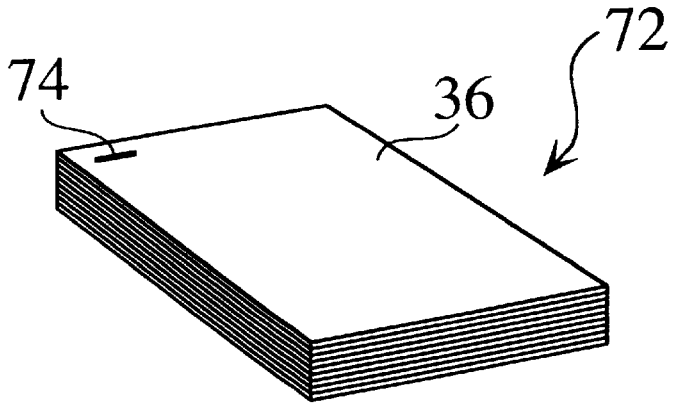
FIG. 6 shows a stapled hybrid document.
Figure 7:
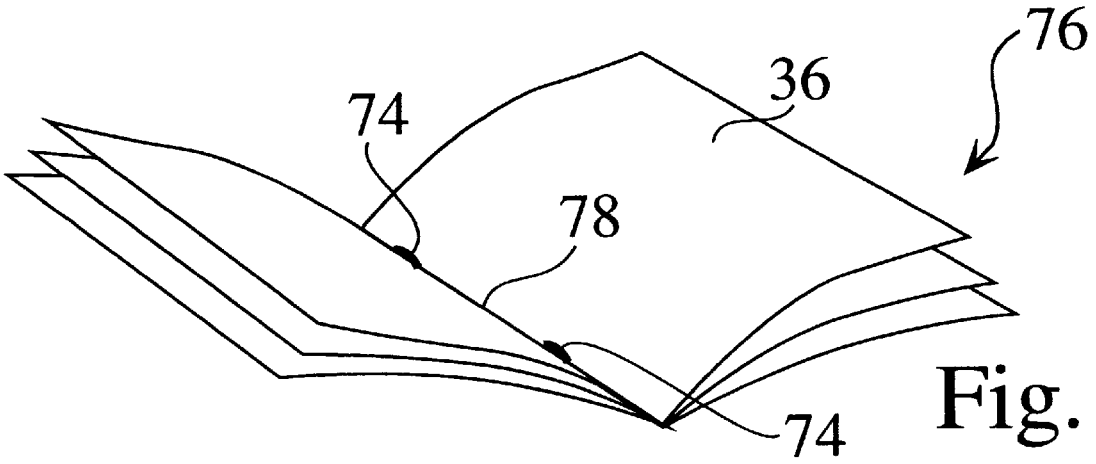
FIG. 7 shows a folded and stapled hybrid document.
Figure 8:
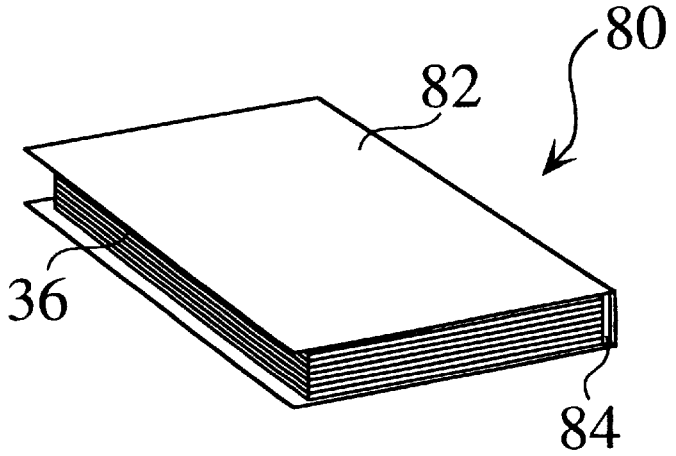
FIG. 8 shows a hybrid document with a glued binding.

In some embodiments of the mixed format finishing process 50, post compiling procedure 54 are also performed on the collated mixed format documents 36, such as folding, covering, stapling, and binding operations (FIGS. 6–8).

In other embodiments of the mixed format finishing process 50, incomplete or miscollated mixed format documents 36 are controllably diverted to an incomplete document storage area 56.

Document Portion Sources. The mixed format finishing device 10 is able to receive and collate pages 18, 20 from a wide variety of document portion sources 52, which may include black and white printers, process color printers, spot color printers, transparent overlay sources, page divider sources, and special page sources (e.g. inserts, special stock, fold-outs, pre-printed, embossed or cut pages). In one embodiment, a plurality of printers 52 are used to provide a high volume of pages 18, 20 to the mixed format finishing device 10, which also allows the system to continue to operate as printers 52 go off-line for service or paper replenishment. Different printers 52 can also be used for different quality print jobs, or for different paper stock supplies.

Figure 3:
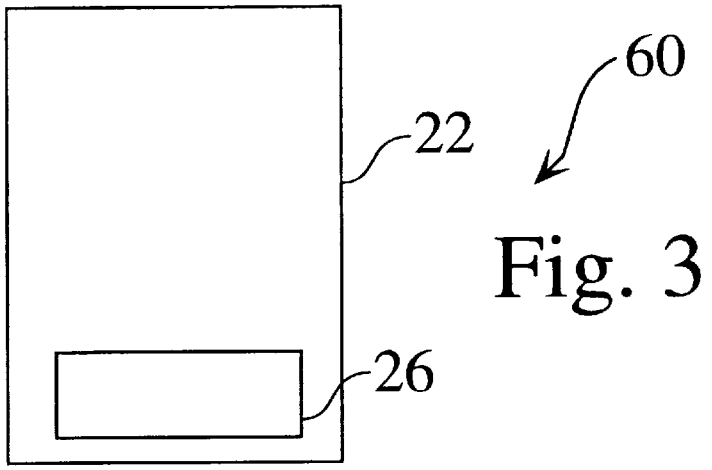
FIG. 3 is a cover sheet having machine readable encoded information.

Cover pages. FIG. 3 shows a top view 60 of a cover page 22 for a basic embodiment of the mixed format finishing device 10, which typically contains encoded information 26 that is machine readable by the compiler sensor 28 and the compiler controller 30.

The encoded information 26 on the cover sheet 22 includes a document map, which is a specification for the order in which pages 18, 20, such as black and white pages 18 and color pages 20, are required to be compiled to produce a hybrid document 36.

Figure 4:
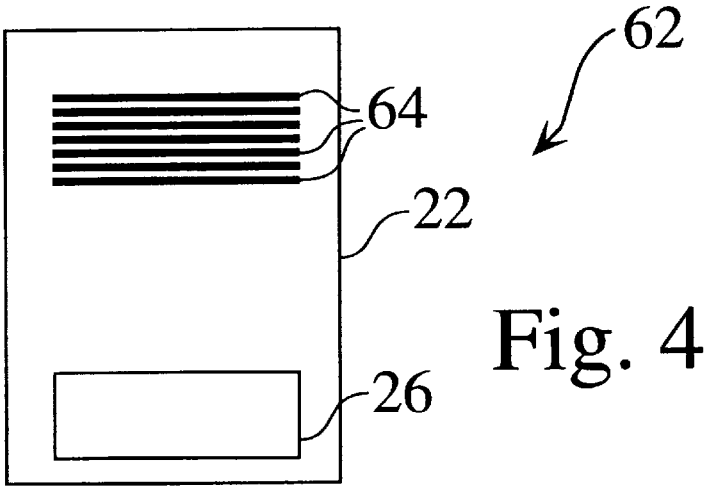
FIG. 4 is a cover sheet having both machine readable encoded information and human readable information.

In a preferred embodiment of the mixed format finishing device 10, cover pages 22 include both machine-readable encoded information 26, and human readable information 64, as shown in the top view 62 of FIG. 4. The human readable information 64 provides users, such as print and finishing room operators, with information regarding the contents of a hybrid document 36, such as the printers 52 used for the pages 18, 20 that make up the hybrid document, the preferred paper stock to be used for pages 18, 20, the order that the pages 18, 20 are to compiled, and post compiling instructions, such as folding, stapling, covering, and binding.

Figure 5:
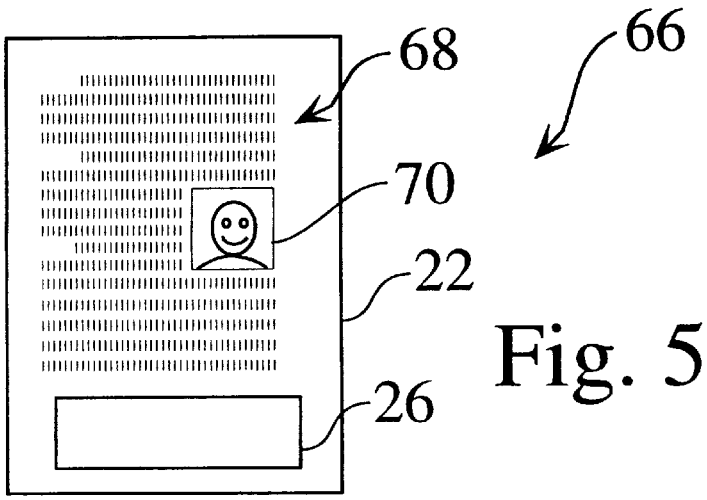
FIG. 5 is a first printed document sheet which includes encoded information.

FIG. 5 is a top view 66 of a cover page 22 which is a page 18, 20 to be included within a hybrid document 36, that also contains encoded information 26. In this preferred embodiment of the mixed format finishing device 10, the cover sheet 22 is an integral page 18,20 to be included within a hybrid document 36. The integral cover sheet 22 does not have to be separated 42 from the compiled document 36, as it functions as a title page for the hybrid document 36, and may contain text 68 or graphics 70.

In some embodiments of the mixed format finishing device 10, a cover sheet 22 is provided as a printed page for each hybrid document 36, and is typically the first page 18 from a black and white printer source 52*a*. When a cover sheet 22 is provided for each hybrid document 36, the cover sheet 22 acts as a divider between hybrid documents 36. When the mixed format finishing device 10 compiles a hybrid document 36 with a given amount of pages 18, 20, it compares the specified page count, which is typically included in the encoded information 26, to the actual pages transferred between the document portion storage bins 14*a*–*n* as counted between subsequent cover sheets 22. If the specified page count differs from the actual page count, the mixed format finishing device 10 controllably routes the hybrid document 36 to an incomplete document storage bin 56.

In another embodiment of the invention, in which multiple hybrid documents 36 having identical specifications are processed, a single cover sheet 22 is provided as the first printed page of the first hybrid document 36, and is typically the first page from a black and white printer source 52*a*.

Post Collation Procedures. As discussed above, after the mixed format hybrid documents 36 are properly collated, they are transferred away from the hybrid document storage bin 34. After collation, the hybrid documents 36 can be processed with other finishing operations, which can also be specified within the encoded information 26 on the cover pages 22. FIG. 6 provides a perspective view 72 of a hybrid document 36 having a staple 74. FIG. 7 is a perspective view 76 of a hybrid document 36 having a center fold 78 and two staples 74. FIG. 8 is a perspective view 80 of a hybrid document 36 having a cover 82 and an adhesive binding 84.

System Advantages. The mixed format finishing device 10 provides many advantages over prior document finishing systems. One advantage is that a portion of the pages 18,20 within a hybrid document 36 which contain only text may be printed on a faster, and less costly black and white printer 52*a*. Another advantage is that the cover sheet 22 controls the document merging process in such a manner that if one mixed format document 36 is misprinted or mismerged, the mismerged mixed format document 36 may be shuttled aside, such as to an incomplete document storage bin 56, and merging may continue with the next complete document set 16*a*–*n*.

In one embodiment of the mixed format finishing system 10, black and white pages 18 are printed on a black and white format printer 52*a*, which includes a cover sheet 22 having encoded information 26, and color pages 20 are printed on a color format printer 52*b*. The black and white pages 18 are then forwarded to the first document portion storage bin 14*a*, and the color pages 20 are forwarded to the second document portion storage bin 14*n*. The mixed format finishing device 10 then compiles the black and white pages 18 and the color pages 20 into a hybrid document 36, wherein the encoded information 26 is used by the device 10 to controllably merge the compiled hybrid document 36. In this manner, black and white pages 18 can be printed quickly and inexpensively on an efficient black and white printer 52*a*, and more expensive or time-intensive printing, such as color printing, can be selectively limited only to pages 20 within a document that require color printing.

Although the mixed format finishing device and its methods of use are described herein in connection with printers and collators, the apparatus and techniques can be implemented for other printing, sorting and assembly devices, or any combination thereof, as desired.

Accordingly, although the invention has been described in detail with reference to a particular preferred embodiment, persons possessing ordinary skill in the art to which this invention pertains will appreciate that various modifications and enhancements may be made without departing from the spirit and scope of the claims that follow.

What is claimed is:

1. A mixed format document finishing device, comprising:

a plurality of document portion feeder locations each adapted to receive one of a plurality of document portions, each of the document portions comprising one or more pages for the mixed format document produced by a corresponding unique format source, at least one of the document portions including a cover sheet having machine readable encoded assembly information which comprises a document map specifying the order for compiling the plurality of document portions to produce the mixed format document; and a document compiler for receiving the plurality of document portions from the plurality of document portion feeder locations, for sensing the machine readable encoded assembly information on the cover sheet, and for compiling the plurality of document portions into the mixed format document according to the document map.

2. The mixed format finishing device of claim 1, wherein at least one of the document portions comprises pages provided by a black and white printer.

3. The mixed format finishing device of claim 1, wherein at least one of the document portions comprises pages provided by a color printer.

4. The mixed format finishing device of claim 1, wherein the encoded assembly information comprises a bar code format.

5. The mixed format finishing device of claim 1, wherein the cover sheet comprises human readable information.

6. The mixed format finishing device of claim 1, wherein the cover sheet comprises text.

7. The mixed format finishing device of claim 1, wherein the cover sheet comprises graphics.

8. The mixed format finishing device of claim 1, further comprising:

means for diverting an incomplete mixed format document to an incomplete mixed format document storage bin.

9. The mixed format finishing device of claim 1, wherein the encoded assembly information includes document cover information.

10. The mixed format finishing device of claim 1, wherein the encoded assembly information includes binding information.

11. A process, comprising:

receiving a plurality of document portions, each of the document portions comprising one or more pages for a mixed format document produced by a corresponding unique format source, at least one of the document portions including a cover sheet having machine readable encoded assembly information which includes a document map specifying the order for compiling the plurality of document portions to produce a finished mixed format document;

sensing the encoded assembly information; and compiling the plurality of document portions into the finished mixed format document according to the document map.

12. The process of claim 11, wherein at least one of the document portions comprises pages provided by a black and white printer.

13. The process of claim 11, wherein at least one of the document portions comprises pages provided by a color printer.

14. The process of claim 11, wherein the encoded assembly information comprises a bar code format.

15. The process of claim 11, wherein the cover sheet comprises human readable information.

16. The process of claim 11, wherein the cover sheet comprises text.

17. The process of claim 11, wherein the cover sheet comprises graphics.

18. The process of claim 11, further comprising:

diverting an incomplete mixed format document to an incomplete mixed format document storage bin.

19. The process of claim 11, wherein the encoded assembly information includes document cover information.

20. The process of claim 11, wherein the encoded assembly information includes binding information.

21. The mixed format finishing device of claim 1, further comprising:

means for diverting the cover sheet away from the mixed format document.

22. The process of claim 11, further comprising:

diverting the cover sheet away from the mixed format document.

* * * * *